US009896814B2

(12) United States Patent
Cox et al.

(10) Patent No.: US 9,896,814 B2
(45) Date of Patent: Feb. 20, 2018

(54) QUAY WALL WITH ABSORPTION BLOCKS AND INTER-CHAMBER FLOW PATHS

(71) Applicant: SmithGroupJJR, Inc., Detroit, MI (US)

(72) Inventors: Jack C. Cox, Middleton, WI (US); Mauricio A. Wesson, Madison, WI (US)

(73) Assignee: SmithGroupJJR, Inc., Detroit, MI (US)

( * ) Notice: Subject to any disclaimer, the term of this patent is extended or adjusted under 35 U.S.C. 154(b) by 23 days.

(21) Appl. No.: 15/144,115

(22) Filed: May 2, 2016

(65) Prior Publication Data

US 2017/0314220 A1 Nov. 2, 2017

(51) Int. Cl.
*E02B 3/04* (2006.01)
*E02B 3/06* (2006.01)

(52) U.S. Cl.
CPC ..... *E02B 3/066* (2013.01); *E02B 3/04* (2013.01); *E02B 3/06* (2013.01)

(58) Field of Classification Search
CPC ... E02B 3/066; E02B 3/06; E02B 3/04; E02B 3/046; E02B 3/14; E02B 3/129; A01K 61/006; E02D 29/025; E02D 17/205; E04B 1/348; E04B 2/14; E04H 17/1404
USPC .... 405/21, 25, 30, 31, 73, 80, 107, 109, 110
See application file for complete search history.

(56) References Cited

U.S. PATENT DOCUMENTS 905,596 A * 12/1908 Smith ..... E02B 3/06 405/21
3,096,621 A * 7/1963 Danel ..... E02B 3/14 405/16
3,118,282 A 1/1964 Jarlan
3,995,434 A * 12/1976 Kato ..... E02B 3/06 405/33
4,175,888 A * 11/1979 Ijima ..... E02B 3/06 405/31

(Continued)

FOREIGN PATENT DOCUMENTS

CA 2271580 A1 11/2000
GB 2418960 A 4/2006

(Continued)

OTHER PUBLICATIONS

Liz Coates, 1,200 Tonnes of 'Honeycomb' Blocks Give New Sense of Hope to Erosion-hit Hemsby, May 27, 2015, hittp://www.greatyarmouthmercury.co.uk/news/1_200_tonnes_of_honeycomb_blocks_give_sense_of_hope_to_erosion_hit_hemsby, pp. 1-8.

(Continued)

*Primary Examiner* — Carib Oquendo
(74) *Attorney, Agent, or Firm* — Brooks Kushman P.C.

(57) ABSTRACT

A quay wall absorption block includes a back wall, a cap, and a half columnar wall extending between the back wall and cap. The half columnar wall defines a plurality of chamber surfaces and mating surfaces on opposite sides thereof such that the chamber surfaces define portions of a plurality of closed-end flow chambers on opposite sides of the half columnar wall when the mating surfaces are in contact with corresponding mating surfaces of other quay wall absorption blocks. The half columnar wall also defines a plurality of flow paths that extends therethrough to fluidly connect the plurality of closed-end flow chambers on opposite sides of the half columnar wall.

8 Claims, 3 Drawing Sheets

(56) References Cited

U.S. PATENT DOCUMENTS

| | | | | | |
|---|---|---|---|---|---|
| 4,413,924 | A | * | 11/1983 | Ijima | E02B 3/06 405/31 |
| 4,479,740 | A | * | 10/1984 | Schaaf | E02B 3/04 405/30 |
| 4,498,805 | A | | 2/1985 | Weir | |
| 4,877,349 | A | * | 10/1989 | Greene | E02B 3/06 405/27 |
| 5,123,221 | A | * | 6/1992 | Legault | E02D 29/025 256/19 |
| 5,778,622 | A | * | 7/1998 | Baker | E02D 17/205 264/275 |
| 6,896,445 | B1 | * | 5/2005 | Engler | E02B 3/046 405/21 |

FOREIGN PATENT DOCUMENTS

| | | | |
|---|---|---|---|
| JP | 63236809 | * | 10/1988 |
| JP | 403224907 | * | 10/1991 |
| KR | 200195535 | | 9/2000 |

OTHER PUBLICATIONS

Takeshi Ijima et al., Permeable Seawall With Reservoir and the Use of "Warock", Chaper 151, Coastal Engineering, 1976, pp. 2623-2642.

Naofumi Shiraishi et al., Quay Wall With Wave Absorber "Igloo", Chapter 154, Coastal Engineering, 1976, pp. 2677-2696.

* cited by examiner

QUAY WALL WITH ABSORPTION BLOCKS AND INTER-CHAMBER FLOW PATHS

TECHNICAL FIELD

This disclosure relates to the field of quay wall construction.

BACKGROUND

Walls beside water extending from water floor to berth level are used in ports and harbors as facilities for berthing and cargo handling. These walls are also used in non-berthing areas to provide access to the water, and can serve as sinks for wave energy to calm waters in a vicinity thereof.

SUMMARY

A quay wall absorption block includes a back wall, a cap, and a half-octagonal columnar wall extending between the back wall and cap. The half-octagonal columnar wall defines a plurality of chamber surfaces and mating surfaces on opposite sides thereof such that the chamber surfaces define portions of a plurality of closed-end octagonal flow chambers on opposite sides thereof when the mating surfaces are in contact with corresponding mating surfaces of other quay wall absorption blocks. The half-octagonal columnar wall also defines a plurality of flow paths that extends therethrough to fluidly connect the plurality of closed-end octagonal flow chambers on opposite sides thereof.

A quay wall includes a plurality of absorption blocks stacked to form a honey comb portion. Each of the absorption blocks includes a back wall, a cap, and a half columnar wall extending between the back wall and cap. Each of the half columnar walls defines a plurality of chamber surfaces and mating surfaces on opposite sides thereof such that the chamber surfaces define portions of a plurality of closed-end flow chambers on opposite sides thereof when the mating surfaces are in contact with corresponding mating surfaces of other of the absorption blocks. Each of the half columnar walls also defines a plurality of flow paths that extends therethrough to fluidly connect the plurality of closed-end flow chambers on opposite sides thereof.

A quay wall absorption block includes a back wall, a cap, and a half columnar wall extending between the back wall and cap. The half columnar wall defines a plurality of chamber surfaces and mating surfaces on opposite sides thereof such that the chamber surfaces define portions of a plurality of closed-end flow chambers on opposite sides thereof when the mating surfaces are in contact with corresponding mating surfaces of other quay wall absorption blocks. The half columnar wall also defines a plurality of flow paths that extends therethrough to fluidly connect the plurality of closed-end flow chambers on opposite sides of the half columnar wall.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
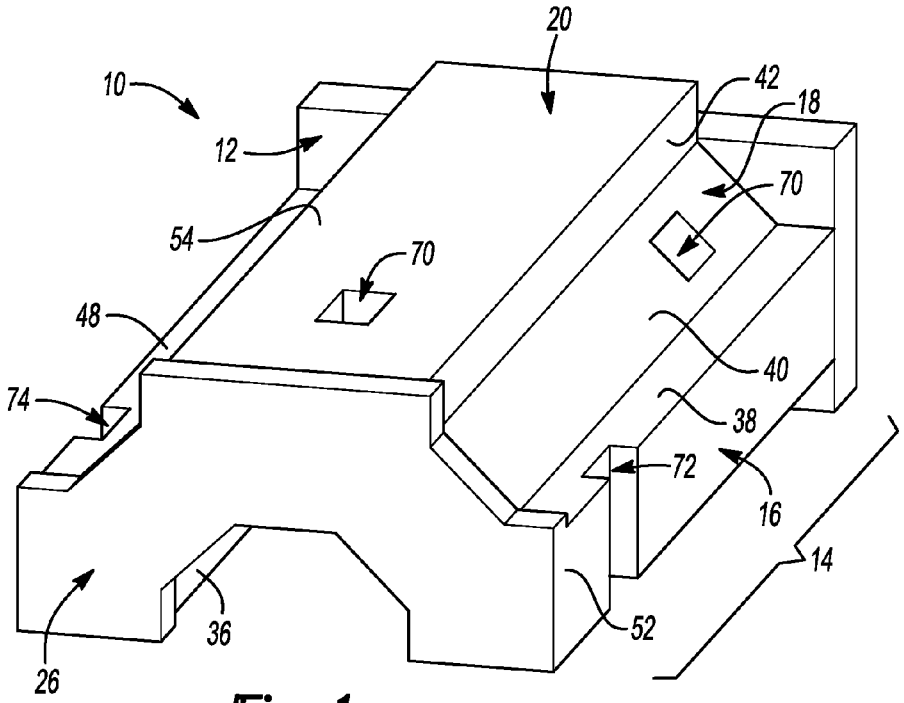
FIGS. 1 and 2 are perspective views of an absorption block.
Figure 2:
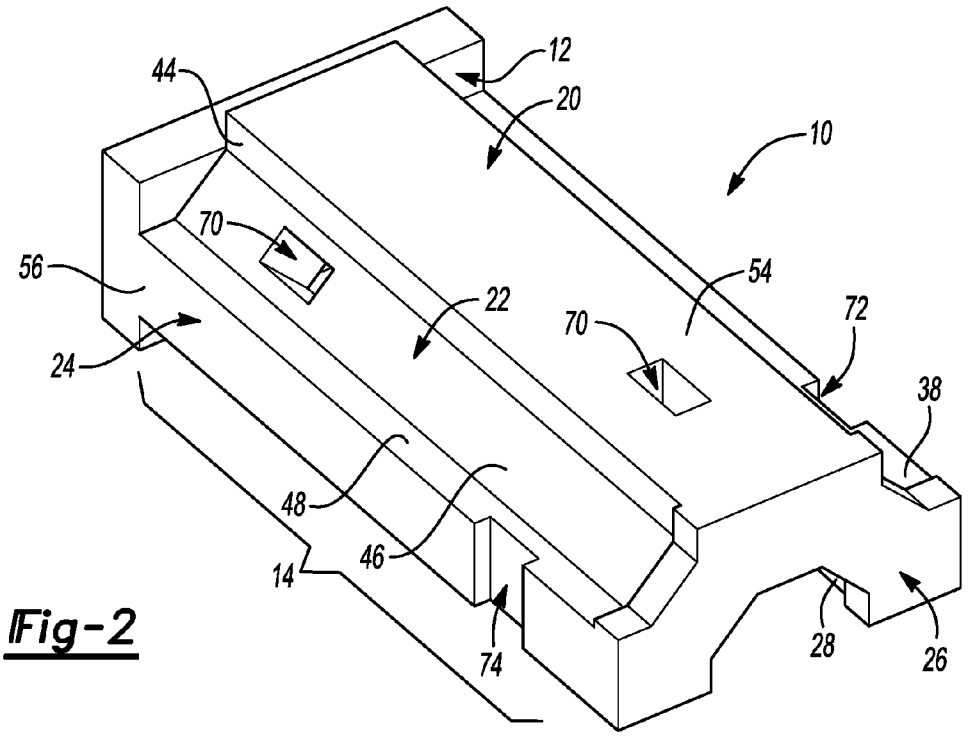
Figure 3:
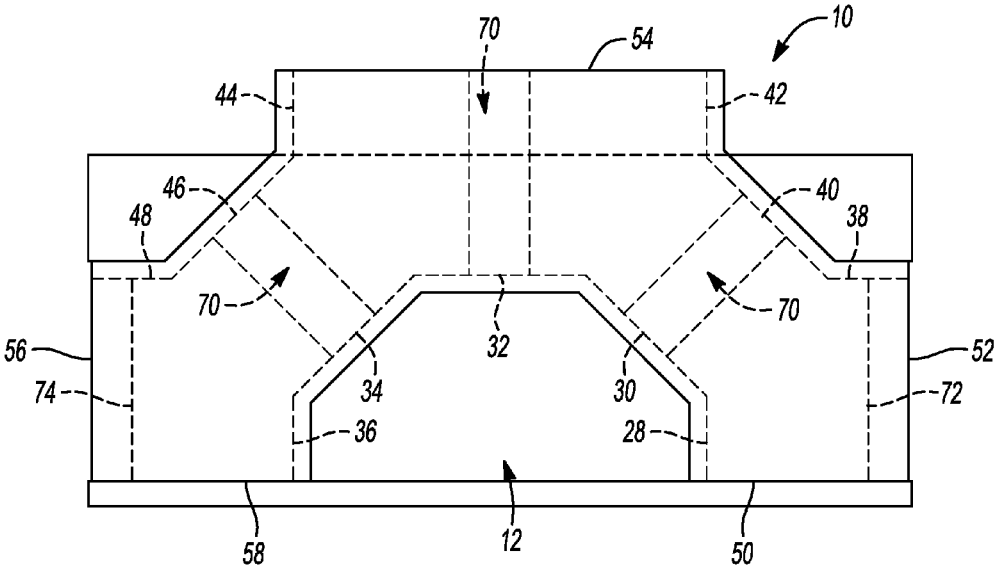
FIG. 3 is a front view of the absorption block of FIGS. 1 and 2.

Referring to FIGS. 1, 2 and 3, an absorption block 10 includes a backing wall 12 and a half-octagonal columnar wall 14 extending therefrom. The half-octagonal columnar wall 14 includes a plurality of side walls 16, 18, 20, 22, 24 arranged to generally form a half-octagon shape, and a cap 26 parallel with and opposite to the backing wall 12. Each of the side walls 16, 18, 20, 22, 24 extends between the backing wall 12 and cap 26.

As discussed more below, the absorption block 10 may be stacked with other such blocks to form portions of a quay wall that defines a plurality of flow chambers into which water may flow. As such, the side walls 16, 18, 20, 22, 24 define chamber surfaces 28, 30, 32, 34, 36 respectively. Likewise, the side walls, 16, 18, 20 define chamber surfaces 38, 40, 42 respectively. And, the side walls 20, 22, 24 define chamber surfaces 44, 46, 48 respectively. Moreover, the cap 26 includes mating surfaces 50, 52, 54, 56. As the name suggests, the mating surfaces 50 52, 54, 56 may be mated with other such mating surfaces of other blocks to form a wave-energy-dissipating structure.

In one example, the mating surface 52 of a first absorption block may be placed in contact with the mating surface 56 of a second absorption block such that the chamber surfaces 38, 40, 42 of the first absorption block and the chamber surfaces 44, 46, 48 of the second absorption block 10 collectively define half of an octagonal flow chamber. To complete the other half of this octagonal flow chamber, the mating surface 58 of a third absorption block may be placed in contact with half of the mating surface 54 of the first absorption block such that the chamber surface 42 of the first absorption block and the chamber surface 36 of the third absorption block are flush with each other, etc. Thus, the chamber surfaces associated with a given half-octagonal columnar wall can partially define a plurality of closed-end flow chambers on opposite sides of the half-octagonal columnar wall as will be apparent with reference to FIG. 4.

Generally speaking, a length of the half-octagonal columnar wall 14 is greater than a width of the cap 26. The length, for example, may be about 4 meters and the width may be about 2 meters. Such dimensions, however, will depend upon the target wave lengths and wave spectrum to be absorbed.

The examples so far have described absorption blocks that form hexagonal flow chambers. Other forms, however, are also contemplated. Some blocks have may have a half-hexagonal or half-circular columnar wall. Such blocks would thus form hexagonal or circular flow chambers respectively. Other blocks may have a quarter-octagonal, quarter-circular, etc. columnar wall.

Figure 4:
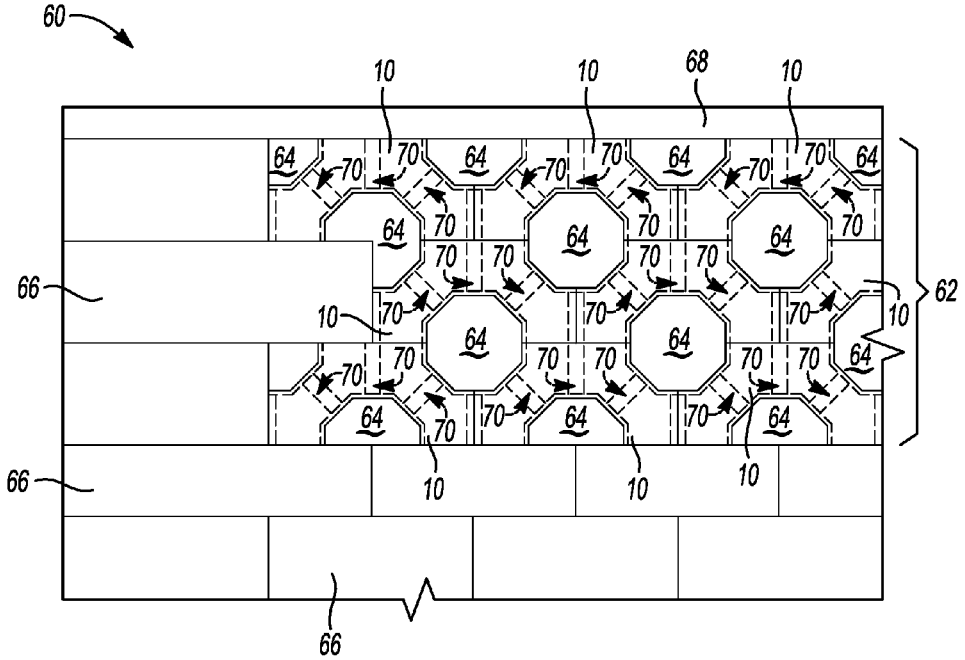
FIG. 4 is a front view of a quay wall.

Referring to FIG. 4, a quay wall 60 includes a plurality of absorption blocks 10 stacked to form a honey comb portion 62 defining a number of closed-end flow chambers 64 (as described above). The void space on the face of the honey comb portion 62 can fall within the range of 25% to 50% for example. The honey comb portion 62 is supported on the bottom and sides by solid rectangular blocks 66, and on top by a cast-in-place ridge 68. Gravel, dirt, etc. may be positioned behind the quay wall for further support. Other supporting arrangements, of course, are contemplated.

As waves approach the quay wall 60, water carried thereby flows into the flow chambers 64 so as to dissipate the energy therewith over a larger surface area as compared with a flat quay wall, which may reflect some of the wave energy and thus further agitate the waters. The inventors, however, have discovered that chamber-to-chamber differences in pressure may limit the wave-energy-absorbing effectiveness of honey comb portions, and that such differences over time may affect long-term durability of any associated quay wall. The inventors have further discovered that constructing the absorption blocks 10 such that they define inter-chamber flow paths 70 acts to reduce chamber-to-chamber differences in pressure, thereby increasing the wave-energy-absorbing effectiveness of the honey comb portion 62 and the long-term durability of the quay wall 60. As above, the size of the flow paths 70 will depend upon the materials being used, the type of waters expected, the size of waves, the target wave periods, wave lengths and wave spectrum associated therewith, etc.

Referring again to FIGS. 1, 2 and 3, each of the mating surfaces 52, 56 defines recesses 72, 74, respectively. The recess 72 extends between the mating surface 50 and the chamber surface 38. The recess 74 extends between the mating surface 58 and the chamber surface 48. When the absorption blocks 10 are arranged as shown in FIG. 4, the recesses 72, 74 of adjacent blocks collectively define corresponding flow paths. Each of the side walls 18, 22 defines one of the flow paths 70. The flow path 70 defined in the side wall 18 extends between the chamber surfaces 30, 40. The flow path 70 defined in the side wall 22 extends between the chamber surfaces 34, 46. The side wall 20 defines one of the flow paths 70. The flow path 70 defined in the side wall 20 extends between the chamber surface 32 and mating surface 54.

The flow paths 70 are rectangular in cross-section. Any suitable cross-sectional shape, however, may be used (e.g., circular, hexagonal, etc.). Moreover, the flow paths defined in the side walls 18, 22 are offset or staggered from the flow path 70 defined in the side wall 20 and the recesses 72, 74. This staggered relationship further improves the pressure-equalizing capability associated with the flow paths 70. In other examples, the flow paths 70 and recesses 72, 74 may be aligned, etc.

Figure 5:
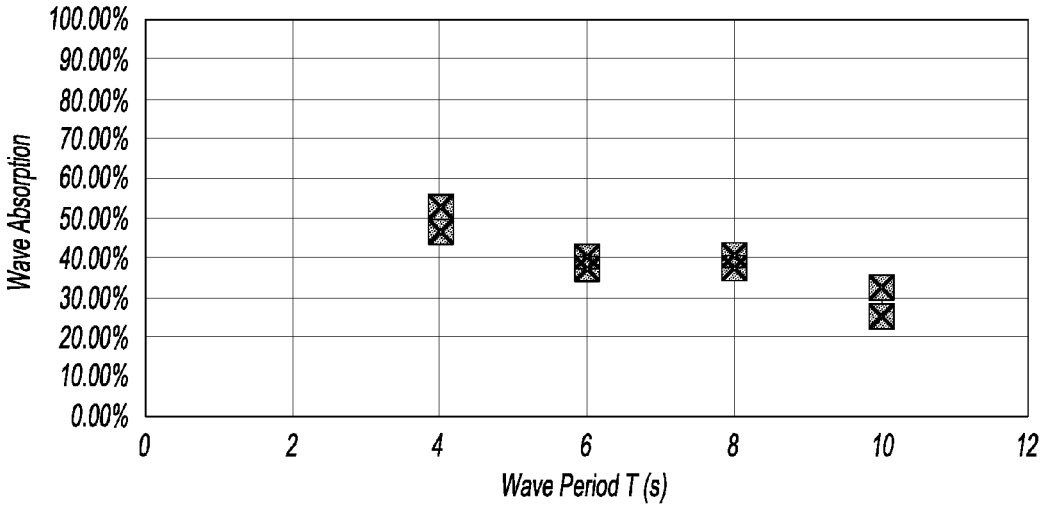
FIG. 5 is a plot of quay wall wave absorption percentage versus wave period.

Referring to FIG. 5, testing was conducted to confirm the functionality and effectiveness of the wave absorbing quay wall blocks contemplated herein. A model wall was constructed and subjected to waves in a wave tank of different periods while measuring the reflection coefficients of the model. The results showed marked improvement over conventional vertical solid walls, absorbing between 30% to 50% of the wave energy—resulting in reductions in reflected waves.

The words used in the specification are words of description rather than limitation, and it is understood that various changes may be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A quay wall absorption block comprising:
a back wall;
a cap; and
a half-octagonal columnar wall extending between the back wall and cap, and defining (i) a plurality of chamber surfaces and mating surfaces on opposite sides of the half-octagonal columnar wall such that the chamber surfaces define portions of a plurality of same-size closed-end octagonal flow chambers on opposite sides of the half-octagonal columnar wall when the mating surfaces are in contact with corresponding mating surfaces of other quay wall absorption blocks, and (ii) a plurality of flow paths that extends through the half-octagonal columnar wall to fluidly connect the plurality of same-size closed-end octagonal flow chambers on opposite sides of the half-octagonal columnar wall, wherein one of the flow paths extends between one of the chamber surfaces and one of the mating surfaces on opposite sides of the half-octagonal columnar wall and through the half-octagonal columnar wall.

2. The quay wall absorption block of claim 1, wherein positions of at least some of the plurality of flow paths are staggered along the half-octagonal columnar wall.

3. The quay wall absorption block of claim 1, wherein the flow paths are rectangular in cross-section.

4. A quay wall comprising:
a plurality of absorption blocks stacked to form a honey comb portion, each of the absorption blocks including a back wall, a cap, and a half columnar wall extending between the back wall and cap, and defining
a plurality of chamber surfaces and mating surfaces on opposite sides of the half columnar wall such that the chamber surfaces define portions of a plurality of same-size closed-end flow chambers on opposite sides of the half columnar wall when the mating surfaces are in contact with corresponding mating surfaces of other of the absorption blocks, and
a plurality of flow paths that extends through the half columnar wall to fluidly connect the plurality of same-size closed-end flow chambers on opposite sides of the half columnar wall, wherein one of the flow paths extends between one of the chamber surfaces and one of the mating surfaces on opposite sides of the half columnar wall and through the half columnar wall.

5. The quay wall of claim 4, wherein the half columnar walls are half-octagonal columnar walls.

6. A quay wall absorption block comprising:
a back wall;

a cap; and a half columnar wall extending between the back wall and cap, and defining (i) a plurality of chamber surfaces and mating surfaces on opposite sides of the half columnar wall such that the chamber surfaces define portions of a plurality of same-size closed-end flow chambers on opposite sides of the half columnar wall when the mating surfaces are in contact with corresponding mating surfaces of other quay wall absorption blocks, and (ii) a plurality of flow paths that extends through the half columnar wall to fluidly connect the plurality of same-size closed-end flow chambers on opposite sides of the half columnar wall, wherein one of the flow paths extends between one of the chamber surfaces and one of the mating surfaces on opposite sides of the half columnar wall and through the half columnar wall.

7. The quay wall absorption block of claim 6, wherein positions of at least some of the plurality of flow paths are staggered along the half columnar wall.

8. The quay wall absorption block of claim 6, wherein the half columnar wall is a half-octagonal columnar wall.

* * * * *